United States Patent [19]

Numata et al.

[11] 4,358,638

[45] Nov. 9, 1982

[54] APPARATUS FOR RECEIVING AN AM STEREOPHONIC SIGNAL

[75] Inventors: Norio Numata; Satoshi Yokoya, both of Tokyo, Japan

[73] Assignee: Sony Corporation, Tokyo, Japan

[21] Appl. No.: 209,024

[22] Filed: Nov. 21, 1980

[30] Foreign Application Priority Data

Nov. 29, 1979 [JP] Japan ..... 54-165213[U]

[51] Int. Cl.[3] ..... H04H 5/00

[52] U.S. Cl. ..... 179/1 GS; 179/1 GM

[58] Field of Search ..... 179/1 GE, 1 GM, 1 GS, 179/1 G

[56] References Cited

U.S. PATENT DOCUMENTS

| | | | |
|---|---|---|---|
| 3,980,832 | 9/1976 | Nakamura et al. | 179/1 GM |
| 4,169,968 | 10/1979 | Parker | 179/1 GS |
| 4,170,716 | 10/1979 | Hilbert et al. | 179/1 GS |
| 4,192,968 | 3/1980 | Hilbert et al. | 179/1 GS |
| 4,218,586 | 8/1980 | Parker et al. | 179/1 GS |

*Primary Examiner*—A. D. Pellinen

*Attorney, Agent, or Firm*—Lewis H. Eslinger; Alvin Sinderbrand

[57] ABSTRACT

Apparatus for receiving an AM stereophonic signal of the type having monaural information represented by amplitude modulations of a signal carrier and stereophonic information represented by phase modulations of the signal carrier. A reference signal generator generates a reference signal that is synchronized with the signal carrier of the received AM stereophonic signal. In one embodiment, the reference signal generator is a phase-locked loop which generates a reference carrier whose frequency is substantially equal to the signal carrier frequency and whose phase is locked to a predetermined signal carrier phase. An amplitude limiter limits the AM stereophonic signal to remove amplitude modulations of the signal carrier and thereby produce an amplitude-limited signal carrier. A demodulator demodulates the information represented by the AM stereophonic signal, and a detector is provided to detect if the stereophonic information will be properly demodulated. A switching arrangement is controlled by the detector to supply the reference signal to the demodulator, whereby the stereophonic information is demodulated, or to supply the amplitude-limited signal carrier to the demodulator, whereby the monaural information is demodulated.

17 Claims, 2 Drawing Figures

APPARATUS FOR RECEIVING AN AM STEREOPHONIC SIGNAL

BACKGROUND OF THE INVENTION

This invention relates to apparatus for receiving an AM stereophonic signal and, more particularly, to such apparatus whereby the mode of operation thereof is changed over from a stereo mode, whereby stereophonic information is reproduced, to a mono mode, whereby monaural information is reproduced, if it is determined that the stereophonic information cannot be properly recovered.

It has been proposed to broadcast stereophonic information on conventional AM broadcast frequencies. Such AM stereophonic transmissions are intended to be compatible with conventional, existing monaural receiving apparatus. In one such proposal, the amplitude of an AM carrier is modulated to provide conventional monaural information which, of course, can be reproduced by existing AM radio receiving apparatus, and to phase modulate the AM carrier with stereophonic information, which phase modulations may be detected by receivers which are specially provided with suitable phase detector circuitry.

With this proposal, if monaural information is represented as L+R, wherein L represents left-channel information and R represents right-channel information, and if stereophonic information is represented as L−R, then an AM stereophonic signal $S_0$ may be represented as:

$$S_0=(1+L+R)\cos(\omega t+\Phi) \quad (1)$$

wherein Φ is a function of the stereophonic information.

From equation (1), it is appreciated that the component (1+L+R) appears as amplitude modulations of the carrier, and the stereophonic component appears as phase modulations Φ of that carrier. Equation (1) may be rewritten as:

$$S_O = \cos\Phi[(1+L+R)\cos\omega t-(L-R+P)\sin\omega t] \quad (2)$$

$$= \cos\Phi\cdot S_A \quad (3)$$

wherein:

ω is the angular frequency of the signal carrier

P is a pilot signal (whose pilot frequency is in the range 5 to 25 Hz)

$$\Phi=\tan^{-1}\frac{L-R+P}{1+L+R} \quad (4)$$

$$S_A=(1+L+R)\cos\omega t-(L-R+P)\sin\omega t \quad (5)$$

From equations (3), (4) and (5), it is seen that the AM stereophonic signal $S_0$ has a carrier component cos ωt, which carrier component is amplitude-modulated by mono information (1+L+R), and also includes a stereo component which is represented by cos Φ in equation (3). From equation (1), it is seen that Φ represents the phase modulations of the signal carrier.

A conventional AM radio receiver serves to recover only the mono amplitude-modulated component of the AM stereophonic signal $S_0$. The phase modulations of the received AM carrier are not detected and, hence, the stereo component cannot be demodulated. One type of AM stereo receiver that has been proposed for demodulating the AM stereophonic signal $S_0$ operates by removing the cos Φ component of equation (3), resulting in the signal component $S_A$ represented in equation (5), and then detecting the amplitude modulations of the cos ωt component as well as the amplitude modulations of the sin ωt component. The information recovered by these detected amplitude modulations then are combined in a straightforward manner to recover the left-channel and right-channels signals L and R.

In an AM stereo receiver of the foregoing type, a phase-locked loop normally is provided in order to generate the various detecting and demodulating signals. However, some conditions may exist which would prevent the proper demodulation of the stereo information. For example, the phase-locked loop may not be phase-locked to the proper signal. Such an error condition in the operation of the phase-locked loop would defeat satisfactory stereo recovery. As another example, the signal intensity level of the received AM stereophonic signal may be so weak that the stereo information carried thereby cannot be recovered. It is desirable, under these circumstances, to operate the stereo receiver as a mono receiver so as to recover at least the monaural information which is carried by the received AM stereophonic signal.

OBJECTS OF THE INVENTION

Therefore, it is an object of the present invention to provide an improved AM stereo receiver.

Another object of this invention is to provide apparatus for receiving an AM stereophonic signal which, under normal operating conditions, recovers stereo information from that signal, but, in the presence of certain, possibly erroneous operating conditions, the mono information is recovered from that signal.

A further object of this invention is to provide an AM stereo receiver which includes detecting circuitry for detecting when the stereo information carried by the AM stereophonic signal cannot be properly demodulated so as to operate the receiver in a mono reproducing mode.

An additional object of this invention is to provide an AM stereo receiver of the type which includes a phase-locked loop, and to operate that receiver in a stereo reproducing mode when the phase-locked loop exhibits a proper phase-locked condition, and to operate that receiver in a mono reproducing mode when it is detected that the phase-locked loop does not exhibit a proper, phase-locked condition.

Yet another object of this invention is to provide an AM stereo receiver which is operable in a stereo reproducing mode if the signal level of the received AM stereophonic signal is satisfactorily high, and to operate that receiver in a mono reproducing mode if it is detected that the signal level of the AM stereophonic signal falls to undesirably low levels.

Various other objects, advantages and features of the present invention will become readily apparent from the ensuing detailed description, and the novel features will be particularly pointed out in the appended claims.

SUMMARY OF THE INVENTION

In accordance with this invention, apparatus is provided for receiving an AM stereophonic signal of the type having monaural information represented by amplitude modulations of a signal carrier and stereophonic information represented by phase modulations of the carrier. The apparatus includes a reference signal generator, such as a phase-locked loop, for generating a reference signal that is synchronized with the received signal carrier. An amplitude limiter limits the AM stereophonic signal to remove amplitude modulations therefrom and thereby produce an amplitude-limited signal carrier. A demodulator is provided for demodulating the information represented by the AM stereophonic signal, and a detector detects when the stereophonic information will not be properly demodulated. A switching arrangement is controlled by the detector to supply the reference signal to the demodulator, whereby the stereophonic information is demodulated, or to supply the amplitude-limited signal carrier to the demodulator, whereby the monaural information is demodulated.

BRIEF DESCRIPTION OF THE DRAWINGS

The following detailed description, given by way of example, will best be understood in conjunction with the accompanying drawings in which.

DETAILED DESCRIPTION OF A PREFERRED EMBODIMENT

Figure 1:
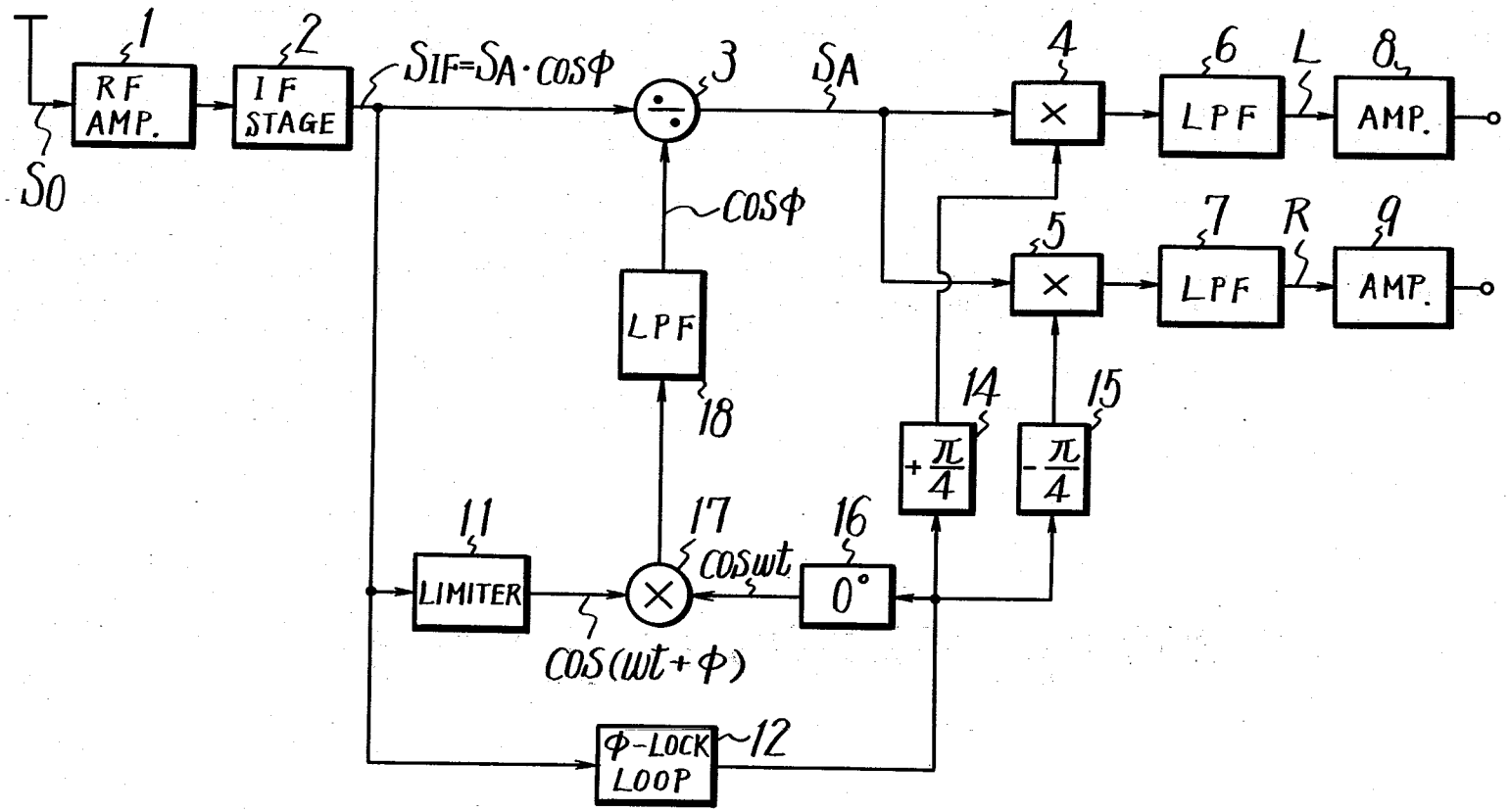
FIG. 1 is a block diagram of a proposed AM stereo receiver.

Referring now to the drawings, wherein like reference numerals are used throughout, FIG. 1 is a block diagram of a proposed embodiment of an AM stereo receiver. This AM stereo receiver is adapted to receive AM stereophonic signals $S_0$ via a radio antenna, a suitable conductive cable, or the like. The received AM stereophonic signal $S_0$, which may be represented by equations (2) and (3) above, is supplied to an RF amplifier 1, which serves to amplify the received signal whose carrier frequency is assumed to be in the radio frequency (RF) range. The output of RF amplifier 1, that is, the amplified stereophonic signal, is supplied to a conventional IF stage 2, wherein the RF signal is converted to the IF range. More particularly, and as one example thereof, the RF frequency may be converted in IF stage 2 to an intermediate frequency of, for example, 455 KHz. Thus, the output of IF stage 2 is an IF AM stereophonic signal which, nevertheless, retains the mathematical expressions set out in equations (2) and (3).

The IF signal $S_{IF}$ produced by IF stage 2 that is, the IF AM stereophonic signal, is supplied to demodulator circuitry by way of a signal divider circuit 3, to be described. The demodulator circuitry is shown as synchronous detectors 4 and 5 which, during normal operation, detect the left-channel and right-channel signals L and R, respectively, which are included in the stereophonic information represented by the AM stereophonic signal. Synchronous detector 4 is coupled to an amplifier 8 via a low pass filter 6. Similarly, synchronous detector 5 is coupled to an amplifier 9 via a low pass filter 7. It may be appreciated that amplifiers 8 and 9 produce amplified left-channel and right-channel stereo signals, respectively.

As is known, a synchronous detector functions to detect the amplitude modulations of a sinusoidal carrier wave supplied thereto. More particularly, if a synchronous detector is supplied with sinusoidal components of different phases, the amplitude modulations of a particular one of those phases is detected, or demodulated, if the synchronous detector also is supplied with a local carrier signal that is phase-synchronized with the desired sinusoidal component. As will be described, signal divider circuit 3 functions to cancel the cos $\Phi$ component of the IF AM stereophonic signal $S_0$, as represented by equation (3), to supply synchronous detectors 4 and 5 with a so-called sound signal component $S_A$, represented mathematically by equation (5). Synchronous detector 4 is supplied with a local carrier, referred to herein as a reference carrier, having a particular phase relationship with respect to the cos $\omega t$ component of equation (5), and synchronous detector 5 is supplied with a reference carrier having a particular phase relationship with respect to the sin $\omega t$ component. Thus, synchronous detector 4 serves to detect the amplitude modulations of the cos $\omega t$ component and synchronous detector 5 serves to detect the amplitude modulations of the sin $\omega t$ component. These detected amplitude modulations then may be combined (not shown) in a straightforward manner to yield the left-channel and right-channel signals, respectively. The circuitry which is used to produce the reference carriers supplied to synchronous detectors 4 and 5 now will be described.

The IF AM stereophonic signals $S_{IF}$, represented mathematically by equations (2) and (3), is supplied to a phase-locked loop 12. As is known, a phase-locked loop is a conventional circuit which includes an adjustable oscillator, such as a voltage-controlled oscillator (VCO) which generates an oscillating signal whose frequency and phase may be controlled by a phase-control signal supplied thereto. As an example, the VCO included in phase-locked loop 12 may generate a sinusoidal oscillating signal sin $\omega t$. The phase-locked loop additionally includes a phase detector, as is conventional, to detect a phase differential between the oscillating signal generated by the VCO and the carrier of the IF signal $S_{IF}$. This phase differential is supplied by a low pass filter as an error signal to adjust the phase of the oscillating signal generated by the VCO. It will be appreciated that, since the component $\Phi$ in equation (1) is an audio frequency component, the VCO is readily locked to the carrier of the IF signal. The oscillating signal generated by the VCO may be represented as sin $\omega t$, and is phase-shifted, such that phase-locked loop 12 generates a reference carrier that is synchronized with the carrier of the IF signal $S_{IF}$ and that is phase-locked to a particular phase component (e.g. cos $\omega t$) of the IF signal.

This phase-locked reference carrier is supplied to synchronous detector 4 via a phase-shift circuit 14 adapted to impart a positive phase shift $+\pi/4$; and the reference carrier is supplied to synchronous detector 4 by a phase-shift circuit 15 adapted to impart a negative phase shift $-\pi/4$. These phase-shifted reference carriers supplied to synchronous detectors 4 and 5 result in the detection of the left-channel and right-channel signals, respectively. That is, synchronous detector 4 is supplied with the reference carrier $$\cos\left(\omega t + \frac{\pi}{4}\right)$$

and the synchronous detector 5 is supplied with the reference carrier $$\cos\left(\omega t - \frac{\pi}{4}\right).$$

Signal divider 3 now will be described. As mentioned above, the purpose of this signal divider is to remove, or cancel, the cos Φ component of the IF signal $S_{IF}$. As one example thereof, signal divider 3 may include transistor circuitry, known to those of ordinary skill in the prior art, such as shown in German Offlegungsschrift 2,455,176, supplied with a signal that is a function of cos Φ. The output of this signal divider is equal to the IF signal $S_{IF}$ divided by, for example, a voltage that is a function of cos Φ. That is, the output of the signal divider is substantially equal to the sound signal component $S_A$.

The divisor signal cos Φ supplied to divider circuit 3, and used to cancel the cos Φ component of the IF signal $S_{IF}$, is referred to herein as a phase information signal and is produced by the combination of phase-locked loop 12, and amplitude limiter 11, a multiplier 17 and a low pass filter 18. Phase-locked loop 12 has been described above and, it is recalled, generates a reference carrier cos ωt. This reference carrier is supplied to multiplier 17 via a 0° phase-shift circuit 16. The purpose of this phase-shift circuit is to insure that the reference carrier supplied to multiplier 17 exhibits a phase of 0° with respect to the IF carrier cos ωt included in the IF signal $S_{IF}$.

Amplitude limiter 11 may comprise a conventional amplitude limiting circuit which functions to remove amplitude modulations of the IF signal $S_{IF}$. With reference to equation (1), it is appreciated that amplitude limiter 11 produces an amplitude-limited signal of substantially constant amplitude and may be represented mathematically as the component cos (ωt+Φ). This amplitude-limited signal is multiplied in multiplier 17 with the zero-phase reference carrier cos ωt, the latter being produced by phase-locked loop 12. Multiplier 17 functions as a modulator, or a mixer, to produce a lower frequency component, whose frequency is equal to the difference between the frequencies of the amplitude-limited signal and the zero-phase reference carrier, and also a higher frequency component, whose frequency is equal to the sum of these frequencies. Low pass filter 18 is coupled to multiplier 17 to pass only the lower frequency components. Thus, low pass filter 18 supplies to signal divider 3 the component which may be mathematically represented as cos (ωt+Φ−ωt)=cos Φ. It is this phase information signal cos Φ that functions as a divisor in signal divider 3 to cancel the cos Φ component of the IF signal $S_{IF}$. Hence, signal divider 3 supplies the sound signal component $S_A$ to synchronous detectors 4 and 5, as shown.

Unfortunately, in the AM stereo receiver shown in FIG. 1, if the signal level of the received AM stereophonic signal $S_0$ is too low, that is, if the received signal exhibits a relatively weak electric field intensity, the IF signal $S_{IF}$ supplied to signal divider 3 is correspondingly weak. Consequently, the signal divider circuit is subjected to unstable operation. Therefore, the stereophonic information contained in, or carried by, sound signal component $S_A$ cannot be properly detected by synchronous detectors 4 and 5. As a result thereof, the left-channel and right-channel information is deteriorated. The separation of the left-channel and right-channel signals likewise is degraded and the distortion factor becomes unsatisfactory. Hence, stereophonic information will not be properly demodulated under these circumstances.

Another disadvantage of the AM stereo receiver shown in FIG. 1 is that phase-locked loop 12 may not properly lock onto the carrier cos ωt of the IF signal $S_{IF}$. This difficulty may be due to a weak AM stereophonic signal $S_0$, a malfunction in the phase-locked loop, or other factors. If the reference carrier is not phase-locked to the carrier of the IF signal, the reference carriers supplied to synchronous detectors 4 and 5 may exhibit unstable phase relationships. Consequently, the synchronous detectors may not operate properly and the aforementioned difficulties of degradation in the left-channel and right-channel signals, poor distortion factor, and the like, will arise. Also, if the reference carrier is not properly phase-locked, the phase information signal cos Φ may be unstable. As a result, the operation of signal divider circuit 3 may be erroneous.

Therefore, if the phase-locked loop does not operate properly, or if the received AM stereophonic signal is relatively weak, an undesired sound, known as a so-called burst sound, may be generated by the AM stereo receiver. Such a transient, abnormal sound is undesired and will interfere with a user's enjoyment of the AM stereo receiver.

Figure 2:
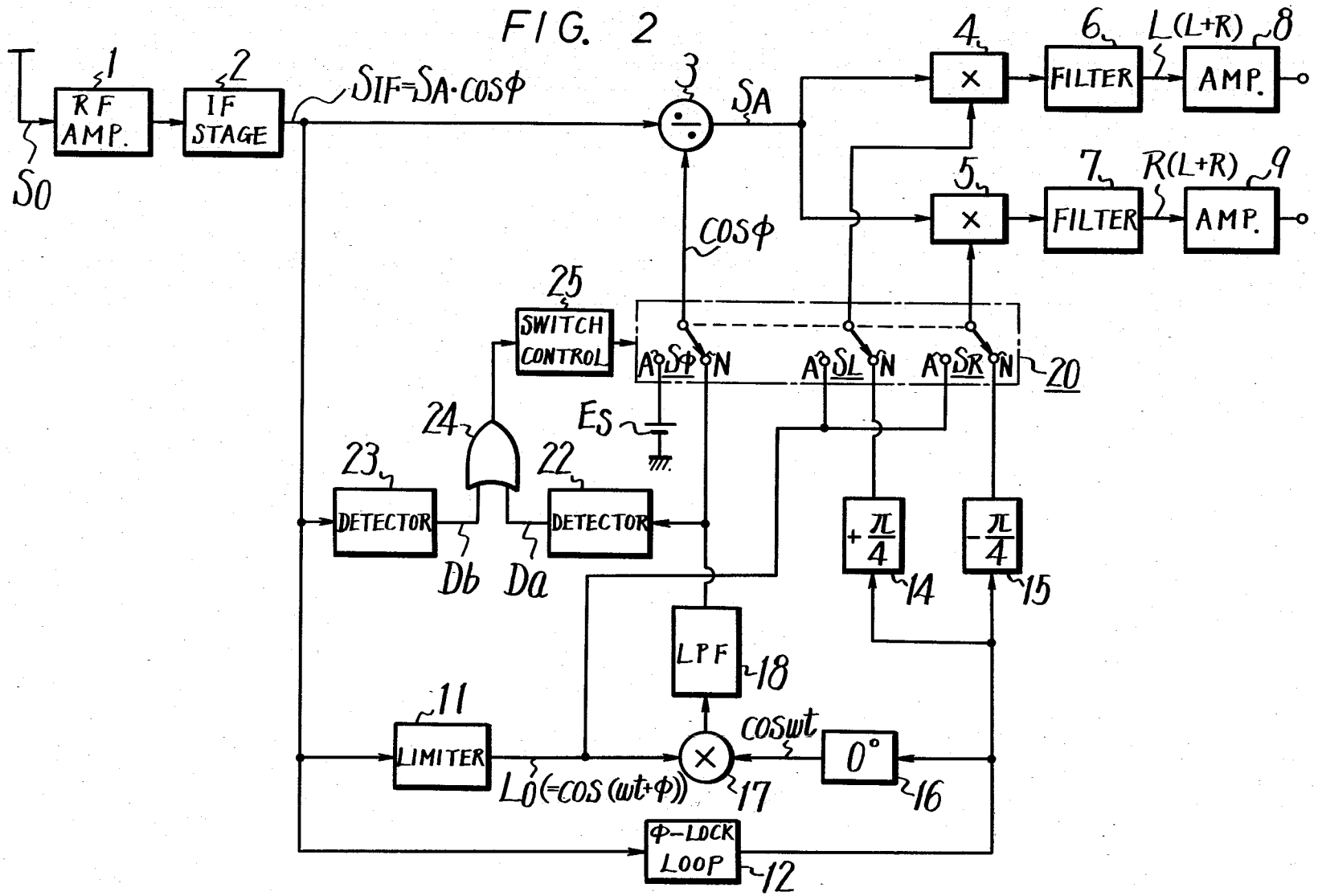
FIG. 2 is a block diagram of a modified AM stereo receiver which incorporates the present invention.

The improved apparatus, illustrated in FIG. 2, overcomes these problems and, moreover, controls the AM stereo receiver to operate in the mono reproducing mode in the event that the received AM stereophonic signal exhibits an undesirably low signal level, or if the phase-locked loop is not properly phase-locked to the IF carrier. As shown, those elements in the improved AM stereo receiver of FIG. 2 which are substantially the same as the aforedescribed elements of FIG. 1 are identified by the same reference numerals. In the interest of brevity, description of such elements is not repeated.

The AM stereo receiver shown in FIG. 2 differs from that shown in FIG. 1 in that a switching circuit 20 is provided, this switching circuit being controlled by a switch control circuit 25 to supply to synchronous detectors 4 and 5 either the reference carrier derived from phase-locked loop 12 or the amplitude-limited signal carrier produced by amplitude limiter 11. A detecting circuit comprised of level detectors 22 and 23 and an OR gate 24 are coupled to switch control circuit 25 to supply a control signal thereto. The switch control circuit is responsive to this control signal to determine the operating condition of switching circuit 20. As will be described, the switching circuit also is adapted to selectively supply either the aforementioned phase information signal cos Φ to signal divider circuit 3 or to supply a constant-level signal, such as a DC signal, thereto.

More particularly, switching circuit 20 is comprised of three switches $S_\Phi$, $S_L$ and $S_R$, all ganged for simultaneous operation. Each switch is illustrated as a mechanical switch having a movable contact selectively engageable with either one of fixed contacts A and N. As will be appreciated, in a preferred embodiment, switching circuit 20 is comprised of three solid-state switching elements, such as transistorized switches, or the like. The output of switch $S_\phi$, that is, the illustrated movable contact thereof, is coupled to signal divider 3 to supply a divisor signal thereto. The output of switch $S_L$ is coupled to synchronous detector 4 to supply a demodulating signal thereto. Finally, the output of switch $S_R$ is coupled to synchronous detector 5.

During a normal, stereo receiving mode of operation of the AM stereo receiver, the respective signals supplied to contacts N are coupled to signal divider circuit 3 and synchronous detectors 4 and 5 by switches $S_\Phi$, $S_L$ and $S_R$, respectively. Accordingly, and as is illustrated, the phase information signal cos Φ produced at the output of low pass filter 18 is supplied to contact N of switch $S_\Phi$. Also, the reference carrier $$\cos\left(\omega t + \frac{\pi}{4}\right)$$

produced at the output of phase shift circuit 14 is supplied to contact N of switch $S_L$; and the reference carrier $$\cos\left(\omega t - \frac{\pi}{4}\right)$$

is supplied from phase shift circuit 15 to contact N of switch $S_R$. During the mono mode of operation of the AM stereo receiver, the respective signals applied to contacts A are supplied to the outputs of switches $S_\Phi$, $S_L$ and $S_R$, respectively. A source of constant-level signal, such as a DC source, is coupled to contact A of switch $S_\Phi$ to supply the constant-level signal $E_S$ thereto. Contacts A of switches $S_L$ and $S_R$ are connected in common to amplitude limiter 11 to receive the amplitude-limited signal carrier $L_0$ produced thereby.

The detector circuit comprised of detectors 22 and 23 and OR gate 24 is adapted to detect when stereophonic information cannot be demodulated properly from the received AM stereophonic signal. As examples of some conditions which would interfere with proper stereo demodulation are a relatively weak AM stereophonic signal, resulting in an IF AM stereophonic signal $S_{IF}$ whose signal level is too low, and the inability of phase-locked loop 12 to be phase-locked to the IF carrier. The former condition is detected by detector 23 which, for example, may comprise a level detector circuit, such as a threshold detector, and the latter condition is detected by detector 22, which also may comprise a level detecting circuit. Detector 22 is coupled to the output of low pass filter 18 and is adapted to detect the signal level of the phase information signal cos Φ. It may be appreciated that, when the reference carrier generated by phase-locked loop 12 is properly phase-locked to the cos ωt component of the IF carrier, the phase Φ of the phase information signal cos Φ varied on the order of ±10° to ±20°. Thus, the DC level of the phase information signal cos Φ will be relatively high. However, if phase-locked loop 12 cannot lock on to the IF carrier, that is, if the reference carrier generated by the phase-locked loop is not properly phase-locked to the cos ωt component, then the phase Φ of the phase information signal cos Φ varies over a range of 0° to ±90°. Hence, the mean DC level of the phase information signal for this condition is relatively low. In particular, the mean DC level of the phase information signal when phase-locked loop 12 is not properly phase-locked is on the order of less than one-half the mean DC level of the phase information signal when the phase-locked loop is properly phase-locked. Detector 22 is adapted to discriminate the DC level of the phase information signal cos Φ. Hence, this detector may comprise a conventional level detector for sensing when the mean DC level of the phase information signal falls below a predetermined threshold level. Detector 22 also may include a trigger circuit, such as a Schmidt trigger, adapted to produce a control signal $D_a$, such as a binary "1", when the mean DC level of the phase information signal cos Φ falls below the aforementioned threshold level. This binary "1" control signal $D_a$ is supplied by OR gate 24 to switch control circuit 25 when it is determined that phase-locked loop 12 cannot be phase-locked to the IF signal carrier.

Detector 12 may comprise a conventional signal level-detector for detecting the level of the IF signal $S_{IF}$. Detector 23 may include a threshold circuit to sense when the IF signal falls below a predetermined threshold level. This detector also may include a Schmidt trigger circuit, or the like, for generating a control signal $D_b$, which is a binary "1", when the signal level of the IF signal $S_{IF}$ is detected as falling below this threshold level. OR gate 24 supplies this binary "1" control signal $D_b$ to switch control circuit 25 when it is determined that the intensity level of the received AM stereophonic signal is too low for proper stereo demodulation.

Switch control circuit 25 is responsive to a binary "1" control signal supplied thereto to change over the respective switches comprising switching circuit 20 such that those signals that are supplied to the respective A contacts are transmitted. When the switch control circuit 25 receives a binary "0", the respective switches exhibit their normal states, whereby the signals supplied to the N contacts thereof are transmitted.

In operation, let it be assumed that detector 23 detects that the signal level of the IF signal $S_{IF}$ exceeds the pre-set threshold level therefor. It is assumed that the IF signal level will exceed this threshold when the received AM stereophonic signal $S_0$ is of sufficient intensity. Let it be further assumed that phase-locked loop 12 is properly phase-locked to the IF carrier. Accordingly, the control signal $D_b$ produced by detector 23 is a binary "0". Also, the mean DC level of the phase information signal cos Φ exceeds the pre-set threshold of detector 22, such that the control signal $D_a$ also is a binary "0". Hence, OR gate 24 supplies a binary "0" to switch control circuit 25; whereby switching circuit 20 exhibits the condition wherein the signals supplied to the N contacts of switches $S_\Phi$, $S_L$ and $S_R$ are supplied to signal divider circuit 3 and synchronous detectors 4 and 5, respectively. Consequently, signal divider circuit 3 serves to cancel the cos Φ component of the IF signal $S_{IF}$, thereby supplying the sound signal components $S_A$ to each of synchronous detectors 4 and 5. Synchronous detector 4 is supplied with the reference carrier $$\cos t\left(\omega t + \frac{\pi}{4}\right),$$

and synchronous detector 5 is supplied with the reference carrier $$\cos\left(\omega t - \frac{\pi}{4}\right).$$

Therefore, synchronous detector 4 functions to derive the left-channel signal L; and synchronous detector 5 functions to derive the right-channel signal R. These respective left-channel and right-channel signals are filtered and amplified, and then supplied to further utilization means (not shown), such as speakers, headphones, or the like. Thus, the AM stereo receiver operates in its normal, stereo reproducing mode.

Now, let it be assumed that the intensity of the received AM stereophonic signal $S_0$ is too weak. Detector 23 detects that the signal level of the IF signal $S_{IF}$ is below the pre-set threshold. Accordingly, the control signal $D_b$ produced by detector 23 is a binary "1". Switch control circuit 25 responds to this control signal to change over switching circuit 20 such that switches $S_{101}$, $S_L$ and $S_R$ transmit the signals supplied to the A contacts thereof. Signal divider circuit 3 thus divides the IF signal $S_{IF}$ by the constant signal level $E_S$; and synchronous detectors 4 and 5 are supplied with the amplitude-limited signal carrier $L_0$ produced by limiter 11. Hence, it is appreciated that the demodulating carriers which are supplied to synchronous detectors 4 and 5 are equal in phase and frequency to the carrier of the IF component supplied thereto by signal divider circuit 3. Each of detectors 4 and 5 thus recover the amplitude modulations of this IF carrier, and both detectors produce the monaural component (L+R). This monaural component is filtered by filters 6 and 7, amplified and then supplied to further utilization means. Hence, it is seen that the AM stereo receiver operates in its mono reproducing mode in the event that the intensity level of the received AM stereophonic signal is too low.

Let it now be assumed that phase-locked loop 12 is not properly phase-locked to the IF carrier. This condition may arise because the IF signal level is too low to achieve phase-lock, or because of some malfunction in the phase-locked loop circuitry. In any event, if the reference carrier produced by phase-locked loop 12 is not properly phase-locked to the cos $\omega t$ component of the IF signal, the mean DC level of the signal derived from low pass filter 18 will be less than the pre-set threshold provided in detector 12. Consequently, the control signal $D_a$ will be a binary "1"; and switch control circuit 25 responds to this binary "1" control signal to change over the switching state of switching circuit 20. Signal divider circuit 3 thus will be supplied with the constant level signal $E_S$; and synchronous detectors 4 and 5 will be supplied with the amplitude-limited signal carrier $L_0$. Hence, and as described above, each of detectors 4 and 5 recovers the monaural component (L+R) from the received AM stereophonic signal. Thus, if the phase-locked loop is not properly phase-locked, the AM stereo receiver operates in its mono reproducing mode.

Thus, in accordance with the present invention, if it is determined that the AM stereo receiver is not capable of properly demodulating the stereophonic information signal carried by a received AM stereophonic signal, the operating mode of the AM stereo receiver will be changed over automatically from a stereo reproducing mode to a mono reproducing mode. Consequently, deterioration in the quality of the reproduced sound is avoided. Furthermore, undesired and annoying burst sounds, as well as other transient noises, are avoided by changing over from the stereo reproducing mode, in which such sounds and noises are perceived, to the mono reproducing mode.

While the present invention has been particularly described with reference to a preferred embodiment, it should be readily appreciated that various changes and modifications in form and details may be made without departing from the spirit and scope of the invention. For example, the phase-locked condition of phase-locked loop 12 can be detected by sensing signals other than the mean DC level of the phase information signal cos $\Phi$. That is, the frequency component cos 2 $\omega t$, which is present when the VCO included in the phase-locked loop is locked to the IF carrier, may be detected. Also, the error signal produced by the phase detector included in the phase-locked loop may be used as an indication of the phase-locked conditions thereof.

Although the present invention has been disclosed for use with an AM stereophonic signal wherein the stereophonic information is represented by phase modulations of the signal carrier, the broad teachings of this invention may be used to control the stereo/mono reproducing mode of an AM stereo receiver that is operable with other types of AM stereophonic signals.

Therefore, it is intended that the appended claims be interpreted as including the foregoing as well as various other changes and modifications.

What is claimed is:

1. Apparatus for receiving an AM stereophonic signal of the type having monaural information represented by amplitude modulations of a signal carrier and stereophonic information represented by phase modulations of said signal carrier, said apparatus comprising reference signal generating means for generating a reference signal synchronized with said signal carrier of the received AM stereophonic signal; amplitude limiter means for limiting said AM stereophonic signal to remove amplitude modulations of said signal carrier and thereby produce an amplitude-limited signal carrier; demodulating means for demodulating the information represented by said AM stereophonic signal; means for supplying said AM stereophonic signal to said demodulating means; switch means having a first state for supplying said reference signal to said demodulating means, whereby said stereophonic information is demodulated, and a second state for supplying said amplitude-limited signal carrier to said demodulating means, whereby said monaural information is demodulated; detecting means for detecting when said stereophonic information will not be properly demodulated to produce a control signal; and switch control means responsive to said control signal for changing over said switch means from said first state to said second state.

2. The apparatus of claim 1 wherein said apparatus further comprises radio receiving means; RF amplifier means coupled to said radio receiving means to produce an RF-amplified signal; and an IF stage coupled to said RF amplifier means to produce an IF signal corresponding to said AM stereophonic signal, said IF signal being applied at least to said reference signal generating means, said amplitude limiter means and said means for supplying an AM stereophonic signal to said demodulating means.

3. The apparatus of claim 1 wherein said reference signal generating means comprises a phase-locked loop supplied with said AM stereophonic signal to generate a reference carrier whose frequency is substantially equal to the frequency of said signal carrier and whose phase is locked to a predetermined phase of said signal carrier.

4. The apparatus of claim 3 wherein said detecting means comprises phase-lock detecting means for detecting the phase-locked condition of said reference carrier to produce said control signal when said reference carrier cannot be phase-locked to said signal carrier.

5. The apparatus of claim 4 wherein said means for supplying said AM stereophonic signal to said demodulating means comprises means for generating a phase information signal whose level varies as a function of the phase modulations of said AM stereophonic signal; and dividing means for dividing said AM stereophonic signal by said phase information signal, the output of said dividing means being coupled to said demodulating means.

6. The apparatus of claim 5 wherein said phase-locked detecting means comprises multiplying means coupled to said amplitude limiter means and to said phase-locked loop for multiplying said amplitude-limited signal carrier and said reference carrier to generate said phase information signal; and level detect means coupled to said multiplying means for detecting the level of said phase information signal to produce said control signal.

7. The apparatus of claim 6 wherein said level detect means comprises a DC level detector for detecting the mean DC level of said phase information signal to produce said control signal at a first level when said mean DC level exceeds a predetermined threshold, whereby said switch means is disposed in said first state, and to produce said control signal at a second level when said mean DC level is less than said predetermined threshold, whereby said switch means is disposed in said second state.

8. The apparatus of claim 6 further comprising a source of predetermined voltage; and additional switch means responsive to said control signal for selectively supplying said phase information signal or said predetermined voltage to said dividing means.

9. The apparatus of claim 1 wherein said detecting means comprises signal level detecting means for detecting if the signal level of said AM stereophonic signal is less than a predetermined level to produce said control signal.

10. The apparatus of claim 9 wherein said control signal is of a first level when the AM stereophonic signal level exceeds said predetermined level, whereby said switch means is disposed in said first state, and said control signal is of a second level when said AM stereophonic signal level is less than said predetermined level, whereby said switch means is disposed in said second state.

11. The apparatus of claim 3 wherein said detecting means comprises a first detector for detecting the phase-locked condition of said reference carrier to produce a first signal when said reference carrier cannot be phase-locked to said signal carrier; a second detector for detecting the signal level of said AM stereophonic signal to produce a second signal when the AM stereophonic signal level is less than a predetermined level; and means for selectively supplying said first or second signal to said switch control means as said control signal.

12. The apparatus of claim 11 wherein said means for supplying said AM stereophonic signal to said demodulating means comprises means responsive to said amplitude-limited signal carrier and to said reference carrier for generating a phase information signal whose level varies as a function of the phase modulations of said AM stereophonic signal; a source of predetermined voltage; additional switch means normally supplying said phase information signal and responsive to said control signal for changing over to supply said predetermined voltage; and dividing means for dividing said AM stereophonic signal by the output supplied by said additional switch means, the output of said dividing means being coupled to said demodulating means.

13. The apparatus of claim 1 wherein said demodulating means comprises a pair of synchronous detectors; said switch means comprises a pair of switching elements, each coupled to a respective synchronous detector, and each being supplied with said amplitude-limited signal carrier and with a component of said reference signal; and phase shift means for shifting the phase of said reference signal to supply a reference signal component phase-shifted by $+\pi/4$ to one of said switching elements and to supply a reference signal component phase-shifted by $-\pi/4$ to the other of said switching elements.

14. Apparatus for receiving an AM stereophonic signal of the type carrying monaural information and stereophonic information, said apparatus comprising an IF stage for producing an IF AM stereophonic signal; phase-locked loop means supplied with said IF AM stereophonic signal to generate a reference carrier whose frequency is substantially equal to the frequency of the IF signal carrier and whose phase is locked to a predetermined phase of the IF signal carrier; amplitude limiter means for limiting said IF AM stereophonic signal to remove amplitude modulations of said IF signal carrier and thereby produce an amplitude-limited signal carrier; synchronous detecting means for demodulating the information carried by said IF AM stereophonic signal; phase-lock detecting means for detecting if said phase-locked loop means is phase-locked with said IF signal carrier; and switch means operative to supply said reference carrier to said synchronous detecting means if said phase-locked loop means is phase-locked with said IF signal carrier, whereby said stereophonic information is demodulated, and operative to supply said amplitude-limited signal carrier to said synchronous detecting means if said phase-locked loop means is not phase-locked with said IF signal carrier, whereby said monaural information is demodulated.

15. The apparatus of claim 14, further comprising multiplier means for multiplying said amplitude-limited signal carrier and said reference carrier to produce a phase information signal whose amplitude varies as a function of phase modulations of said signal carrier; and signal dividing means for dividing said IF AM stereophonic signal by said phase information signal if said phase-locked loop means is phase-locked with said IF signal carrier and for dividing said IF AM stereophonic signal by a constant signal level if said phase-locked loop means is not phase-locked with said IF signal carrier, the output of said signal dividing means being supplied to said synchronous detecting means.

16. Apparatus for receiving an AM stereophonic signal of the type carrying monaural information and stereophonic information, said apparatus comprising an IF stage for producing an IF AM stereophonic signal; phase-locked loop means supplied with said IF AM stereophonic signal to generate a reference carrier whose frequency is substantially equal to the frequency of the IF signal carrier and whose phase is locked to a predetermined phase of the IF signal carrier; amplitude limiter means for limiting said IF AM stereophonic signal to remove amplitude modulations of said IF signal carrier and thereby produce an amplitude-limited signal carrier; synchronous detecting means for demodulating the information carried by said IF AM stereophonic signal; signal level detecting means for detecting the intensity level of said IF AM stereophonic signal; and switch means operative to supply said reference carrier to said synchronous detecting means if the intensity level of said IF AM stereophonic signal exceeds a threshold, whereby said stereophonic information is demodulated, and operative to supply said amplitude-limited signal carrier to said synchronous detecting means if the intensity level of said IF AM stereophonic signal is less than said threshold, whereby said monaural information is demodulated.

17. The apparatus of claim 16, further comprising multiplier means for multiplying said amplitude-limited signal carrier and said reference carrier to produce a phase information signal whose amplitude varies as a function of phase modulations of said signal carrier; a constant level source; signal dividing means for dividing said IF AM stereophonic signal by a signal supplied thereto, the output of said signal dividing means being supplied to said synchronous detecting means; and additional switch means for supplying said phase information signal to said signal dividing means if the intensity level of said IF AM stereophonic signal exceeds said threshold and for supplying said constant level to said signal dividing means if the intensity level of said IF AM stereophonic signal is less than said threshold.

* * * * *